United States Patent [19]

Rice

[11] 4,391,065

[45] Jul. 5, 1983

[54] COVER PLATE FOR ACCESS OPENING

[75] Inventor: Dennis A. Rice, Dubuque, Iowa

[73] Assignee: Deere & Company, Moline, Ill.

[21] Appl. No.: 286,796

[22] Filed: Jul. 27, 1981

[51] Int. Cl.[3] ..... E05C 21/02

[52] U.S. Cl. ..... 49/465; 49/398

[58] Field of Search ..... 49/465, 466, 463, 389, 49/398, 261; 296/146; 180/69 R, 69.1; 16/262

[56] References Cited

U.S. PATENT DOCUMENTS

| | | | |
|---|---|---|---|
| 2,156,110 | 4/1939 | Brukner | 49/465 X |
| 3,670,835 | 6/1972 | Ross et al. | 180/69.1 |
| 4,098,025 | 7/1978 | Stock et al. | 49/398 X |
| 4,322,107 | 3/1982 | Ishizuka et al. | 296/146 |

*Primary Examiner*—Philip C. Kannan

[57] ABSTRACT

A cover plate is provided for an access opening in a plate structure that forms part of a housing. The cover plate has a rod at one end thereof that has opposite ends bent toward the plate structure and engaging the internal surface of the plate structure. The plate structure also has lips thereon that engage the internal surface of the plate cover and limit movement of the plate structure to a position in which its edges are co-extensive with the edges of the opening. A further means is provided between the plate structure having the opening and the cover plate which draws the cover plate into engagement with the stops or lips while, at the same time, distorting or stressing the rod as the rod end of the cover is forced into the closed position. By placing such stress on the rod, the entire plate cover is held firmly against the lips and is prevented from rattling or becoming loose.

8 Claims, 7 Drawing Figures

COVER PLATE FOR ACCESS OPENING

BACKGROUND OF THE INVENTION

In large land-working vehicles in which there is provided expensive and complicated hydraulic and/or electronic devices, there is commonly provided a housing structure which covers such devices. Due to the nature of the activity of the earth-moving piece of equipment, this housing structure often is of a thick steel plating which can withstand jagged and rugged terrain. Provided in the plate structure forming the housing are access openings so that an operator or a mechanic can work on the more complicated devices covered by the housing. Commonly, the cover plate is a very thick metal plate and may, in some instances, be bolted in its closed position by suitable structure provided on the housing. One problem that exists with such cover plates is that in many instances, it is necessary to work from under the vehicle for removing the plate. It is often difficult to judge the amount the bolts have been loosened. In some instances, the cover plate will break loose and can fall on the person under the vehicle, causing injury to him.

Another common method of mounting a cover plate is to provide a hinge along the edge of the cover plate and bolts to hold the cover plate in a closed position. However, one of the problems that exists with such a mounting arrangement is that often, the hinge pin or the hinges carried by the cover plate or plate structure become worn and cause rattles or other noise to occur at the location of the cover plate. Also, as the cover plate becomes loose, due to the hinge, it will lead into other problems, such as permitting dirt and foreign matter to enter into the small cracks or breaks in the housing around the cover plate. Also, hinge assemblies are often difficult to remove or disassemble when it is desired to completely remove the cover plate.

DESCRIPTION OF THE PRESENT INVENTION

With the above in mind, it is a primary object of the present invention to provide a cover plate for an access opening in a housing and to provide simple structure for mounting the cover and for holding it in a tight, noiseless closed position. The access opening in the housing is shaped to have a main part and an extension part to one side of the main part. The cover plate is of the size and shape to fit into the opening and the portion of the cover plate that fits into the extension part of the opening carries on its internal surface a rod element which extends beyond the edges of the cover plate and engages the internal surface of the plate structure forming part of the housing. Also provided on the internal surface of the plate structure are small lips or stop elements that engage the internal surface of the cover plate and limit movement of the cover plate to that in which the internal and external surfaces of the cover plate and plate structure are substantially co-planar. The rod element serves as a hinge. The end sections of the rods are bent toward the internal surfaces of the plate structure. Provided on the opposite side of the plate structure is a bolt, or other means, which can draw the cover plate against the stop elements while at the same time, distorting the rod end sections as that end of the cover plate is forced into position against the stops. Through the distortion of the rod end sections, there is created a biasing force causing the cover plate to be held firmly in position. Thus, there is eliminated the rattling and noise that would otherwise occur, as well as making a comparatively tight fit between the cover plate and the edges of the opening in the plate structure.

DESCRIPTION OF THE PREFERRED EMBODIMENT

Figure 1:
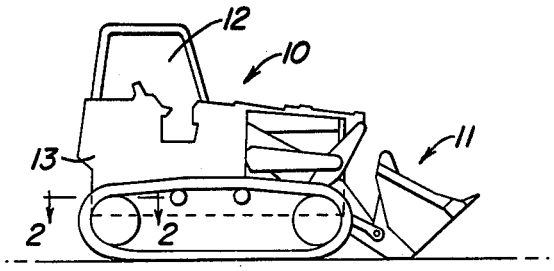
FIG. 1 is a side view of a crawler-type tractor utilizing the structure of the present invention.

Referring now to FIG. 1, there is provided a large crawler tractor 10 having a loader device 11 at its forward end which is controlled from an operator's station 12. For such a tractor, there is normally provided a hydraulic drive, not shown, which is contained in a large housing structure 13 at the rear center portion of the tractor. Since the tractor normally operates in areas where stones, jagged rocks, and foreign matter may extend up through the ground, the housing structure 13 is made up of rather thick metal plating which will withstand abuse from such material.

Figure 2:
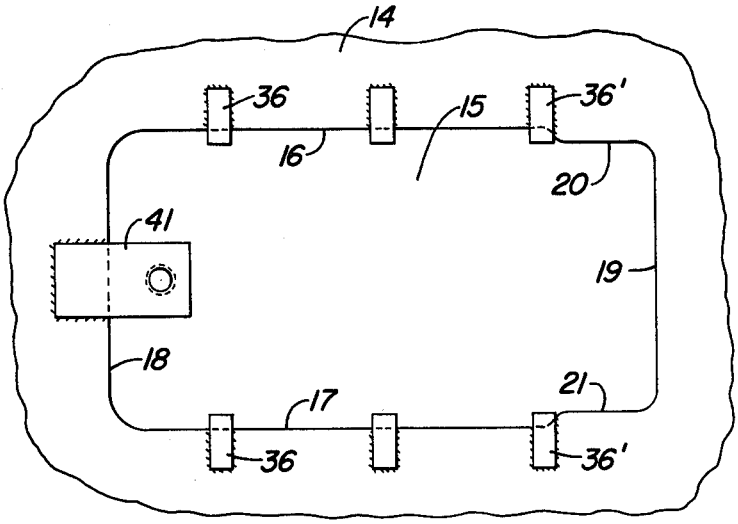
FIG. 2 is a plan view looking downwardly at a part of and from inside of the housing structure. Reference to FIG. 1 will indicate that the view is taken substantially aong the line 2—2 of FIG. 1.

On the underside of the housing structure, there is provided a plate structure 14 which may have several access openings, one of which is shown at 15, under the transmission, engine, or hydraulic controls. In the particular instance shown, the plate structure 14 is on the lower rear portion of the housing and the access opening permits entry from underneath the tractor into the hydraulic mechanism for the tractor. It should, however, be understood that the cover plate, and its method of mounting and moving in and out of position, as presently described, may be used on numerous devices and in different locations. The plate structure 14 extends outwardly from edges 16, 17 that define opposite sides of the opening 15 and from edges 18, 19 which define the ends of the opening. As clearly shown in FIG. 2, the edges 16, 17 and 18, 19 are parallel to one another. The edges 16, 17 extend, in length, a major portion of the opening to a reduced or smaller end extension of the opening adjacent the end 19, such being defined by longitudinal, parallel edges 20, 21 that are inwardly with respect to the edges 16, 17.

Figure 3:
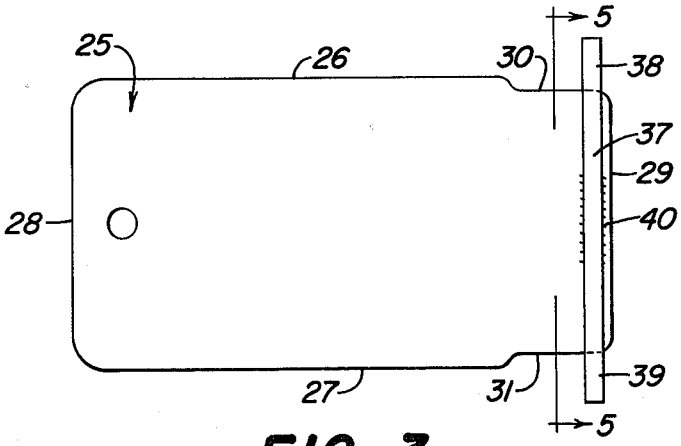
FIG. 3 is a plan view of the cover plate taken from the internal side of the plate.
Figure 4:
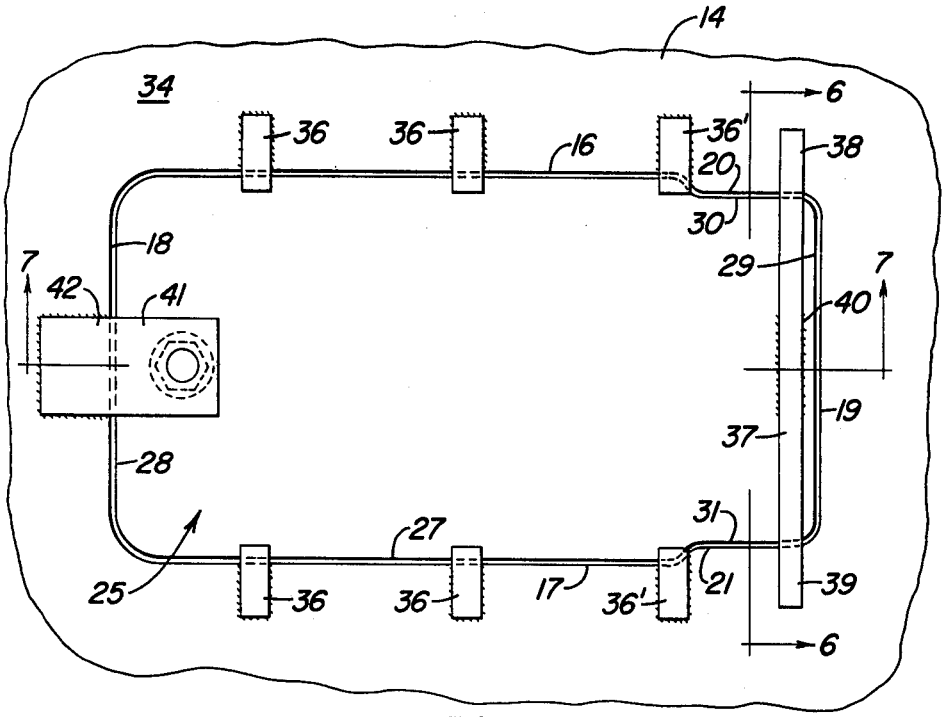
FIG. 4 is a plan view similar to FIG. 2 with the cover plate inserted in its proper position with respect to the remainder of the housing structure and the access opening.

Referring now to FIG. 3, the cover plate 25 has parallel and longitudinally extending edges 26, 27 and end edges 28, 29. A reduced end portion, defined by edges 30, 31, which are also parallel to one another, extends from the end edge 29 and joins with the edges 26, 27 at junctures a short distance from the edge 29. As can best be seen from viewing FIGS. 2, 3, and 4, the cover plate 25 fits into and has the same shape as the opening 15. Thus, the cover plate has an enlarged portion between the edges 26, 27 that closes the main part of the opening 15 and a small portion between the edges 30, 31 that closes the matching part of the opening 15 between the edges 20, 21.

Figure 6:
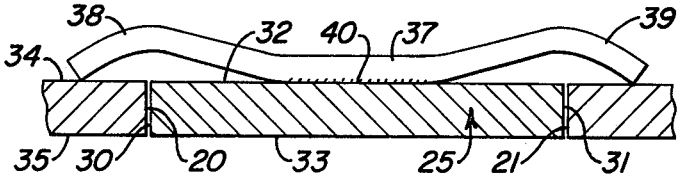
FIG. 6 is a sectional view taken substantially along the line 6—6 of FIG. 4.
Figure 7:
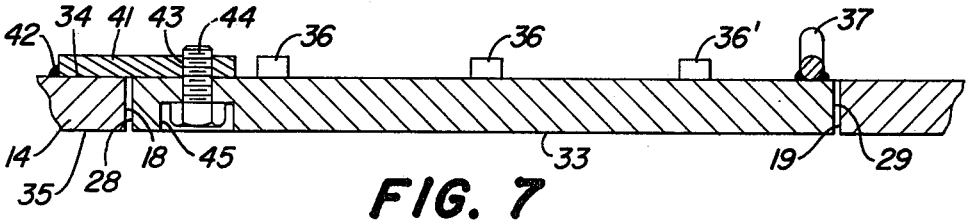
FIG. 7 is a sectional view taken substantially along the line 7—7 of FIG. 4.

When in place, as shown in FIG. 6, the cover plate 25 has internal and external surfaces 32, 33 that are co-planar or co-extensive with the internal and external surfaces 34, 35 of the plate structure 14 forming part of the housing. Welded to the internal surface 34 is a series of stop plates or elements 36 that extend into the opening 15 and serve to limit the movement of the cover plate to a position in which the internal surface 32 of the cover plate is co-extensive or co-planar with the surface 34 of the plate structure. Two of the stop elements 36' are on opposite sides of the opening 15 and in the area where the respective edges 20, 21 join with the edges 16, 17. Reviewing FIG. 4, it should also be noted that the stop elements 36, 36' extend into the opening 15 about the same distance as the edges 20, 21 are inboard of the edges 16, 17, respectively.

Figure 5:
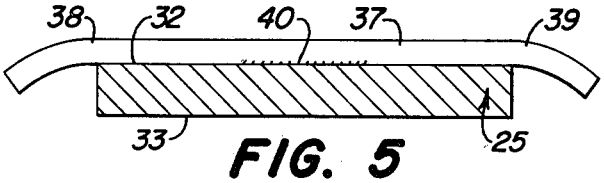
FIG. 5 is a sectional view taken substantially along the line 5—5 of FIG. 3.

Referring now to FIG. 5, a hinge rod 37 extends across the small end portion of the cover plate 25. It is welded at 40 to the internal surface 32 at the central portion of the rod 37. The rod 37 has opposite end sections 38, 39 that project outwardly from the central welded portion. The extreme end portions of the end sections 38, 39 are bent or turned toward the outer side 33 of the cover plate 25 and extend out of the plane of the surface 32.

At the end of the opening 15, defined by the edge 18, there is provided a latch plate 41, welded at 42 to the internal surface 34 of the plate structure 14, extending into the opening 15. The latch plate 41 has a threaded opening 43 that receives the end of a bolt 44. The latch plate 41 may also serve as a stop at the end of the opening 15 that engages the interior surface of the cover plate 25. The bolt 44 is carried in a recessed opening 45 formed in the outer surface 33 of the cover plate, such being necessary in order to prevent the head of the bolt 44 from being harmed by contacting jagged stones or other material that can be found where industrial loaders are used.

Assuming the cover 25 is completely removed from the access opening 15, it can be replaced by inserting the small end of the cover and the rod 37 through the large portion of the access opening and turning it to its correct attitude. The small end of the cover plate may be moved between the stop elements 36, 36' until the rod end is in the small end of the opening 15. The rod 37 may then rest upon the internal surface 34 of the plate 14. The rod is used as a hinge rod and the plate raised into a position in which the bolt 44 may be started into the threaded opening 43. By tightening the bolt 44, the cover plate 25 is moved into a position of contact with the stops 36, 36'. As this occurs, the rod 37, and particularly the end sections 38, 39, will be bent from their free state, as shown in FIG. 5, into their deformed state, as shown in FIG. 6. The rod 37 then operates as a spring to tightly hold the small end of the cover plate 25 on the plate 14. This will, of course, prevent any rattling or loosening of the cover plate 25 at that end. The bolt 44 will hold the opposite end tightly against the latch plate 41 and the stops 36, 36'. The stops 36, 36' serve as lips that contact the upper surface 32 of the cover plate.

When it is desired to remove the cover plate 25, the bolt 44 is removed and the cover plate 25 is permitted to swing downwardly using the rod 37 as a hinge pin. The cover plate then may be turned 90 degrees and completely removed from the access opening 25. It should also be understood that the two stop elements 36' will prevent the rod from accidentally moving into the large portion of the access opening 15 and consequently, the cover plate 25 is prevented from accidentally twisting or turning unless the operator actually lifts the rod 37 over the stop element 36'.

I claim:

1. In combination, a plate structure forming part of a housing and having an access opening therein; a cover plate positioned in said opening having an enlarged portion closing the main part of the opening and a small portion contiguous with and extending from the enlarged portion closing a matching part of the opening, said plate structure and said cover plate having internal and external surfaces extending from the respective edges of the opening and plate; a series of rigid stop elements fixed to the internal surface of the plate structure adjacent the edges of the opening and extending beyond the edges into said opening and engaging the internal surface of the cover plate so as to limit movement of the cover to a position in which the internal and external surfaces of the plate structure and cover are co-extensive at their edges, and in which two of the elements are on opposite sides of the opening in the areas where the edges forming said main part of the opening join the edges forming the aforesaid matching part of the opening; a rod fixed to the internal surface of and extending across the small portion of the cover plate and having opposite end sections that extend beyond the opposite edges of the small portion and engage the internal surface of the plate structure, said end sections being inclined in a direction toward the external surface and when in a free state, extending to ends beyond the internal surface; and means spaced from said rod and extending between the plate structure and cover plate for drawing the cover plate against the stop elements to thereby distort said rod end sections.

2. In combination, a plate structure forming part of a housing and having an access opening therein; a cover plate positioned in said opening having an enlarged portion closing the main part of the opening and a small portion contiguous with and extending from the enlarged portion closing a matching part of the opening, said plate structure and said cover plate having internal and external surfaces extending from the respective edges of the opening and plate; stops fixed to the plate structure adjacent the edges of the opening and extending beyond the edges into said opening and engaging the internal surface of the cover plate so as to limit movement of the cover to a position in which the internal and external surfaces of the plate structure and cover are co-extensive at their edges; a rod fixed to the internal surface of and extending across the small portion of the cover plate to opposite end sections that extend beyond the opposite edges of the small portion and engage the internal surface of the plate structure, said end sections being inclined in a direction toward the external surface and when in a free state, extending to ends beyond the internal surface; and means spaced from said rod and extending between the plate structure and cover plate for distorting said rod end sections against the internal surfaces of said plate structure and to maintain the cover plate tightly against said stops.

3. In combination, a plate structure forming part of a housing and having an access opening therein; a cover plate positioned in said opening, said plate structure and said cover plate having internal and external surfaces extending from the respective edges of the opening and plate; stops adjacent the edges and fixed to one of the plate structure or cover and engaging the other of the plate structure or cover when the cover is in a closed position in which the internal and external surfaces of the plate structure and cover are co-extensive at their edges; a rod fixed to the internal surface of and extending across an end portion of the cover plate to opposite end sections inclined in a direction toward the external surface and when in a free state, extending to ends beyond the internal surface, said rod end sections being distorted when the plate structure and cover are co-extensive at their edges; and means spaced from said rod and extending between the plate structure and cover plate for moving and retaining the cover plate to and in its closed position.

4. The invention described in claim 3 in which the cover has a small extension at one of its ends, and said rod is fixed to that portion of the cover, said access opening has a matching portion to receive the extension, said stops are lips fixed to the plate structure and having surfaces that face and engage the internal surface of the cover plate when the latter is in its closed position.

5. The invention described in claim 4 in which the stops are elements that are fixed to and extend internally of the internal surface of the plate structure and in which at least two of the elements are located to prevent the rod from leaving the area of the portion of the opening that receives said extension.

6. In combination, a horizontal plate structure forming part of a housing and having an access opening therein; a cover plate positioned in said opening having a large portion closing the main part of the opening and a small portion contiguous with and extending from the large portion closing a matching part of the opening, said plate structure and said cover plate having upper internal and lower external surfaces extending from the respective edges of the opening and plate; a series of rigid stop elements fixed to the internal surface of the plate structure adjacent the edges of the opening and extending beyond the edges into said opening and engaging the upper internal surface of the cover plate so as to limit movement of the cover to a position in which the upper internal and lower external surfaces of the plate structure and cover are co-extensive at their adjoining edges, and in which two of the elements are on opposite sides of the opening in the areas where the edges forming said main part of the opening join the edges forming the aforesaid matching part of the opening; a rod fixed to the upper internal surface of and extending across the small portion of the cover plate to opposite end sections that extend beyond the opposite edges of the small portion and engage the internal surface of the plate structure and which are inclined in a direction toward the external surface and beyond the internal surface; and a bolt at the opposite end of the cover plate extending between the plate structure and cover plate retaining the cover plate against the stops and when tightened, distorting said rod end sections against the internal surfaces of said plate structure.

7. The invention described in claim 6 in which said stop elements extend into the opening at no greater distance than the small portion of the cover plate is inward of the large portion.

8. The invention described in claim 6 in which a part of the stop elements are at the juncture of the small to the large portion of the cover plate and project upwardly from the internal surface of the plate structure to thereby block passage of the rod end sections into the main part of the opening.

* * * * *